US005833399A

United States Patent [19]

Bullivant

[11] Patent Number: 5,833,399

[45] Date of Patent: Nov. 10, 1998

[54] APPARATUS FOR USE IN FORMING PILES

[75] Inventor: Roger A. Bullivant, Burton-on-Trent, England

[73] Assignee: Global Innovations, LLC, Grand Prairie, Tex.

[21] Appl. No.: 669,370

[22] PCT Filed: Jan. 5, 1995

[86] PCT No.: PCT/GB95/00010

§ 371 Date: Jul. 8, 1996

§ 102(e) Date: Jul. 8, 1996

[87] PCT Pub. No.: WO95/18892

PCT Pub. Date: Jul. 13, 1995

[30] Foreign Application Priority Data

| | | | |
|---|---|---|---|
| Jan. 6, 1994 | [GB] | United Kingdom | 9400140 |
| Sep. 19, 1994 | [GB] | United Kingdom | 9418843 |

[51] Int. Cl.[6] ..... E02D 5/34

[52] U.S. Cl. ..... 405/233; 405/242

[58] Field of Search ..... 405/231, 232, 405/233, 236, 240, 241, 242, 244, 249, 252.1; 52/157

[56] References Cited

U.S. PATENT DOCUMENTS

| | | | |
|---|---|---|---|
| 2,008,521 | 7/1935 | Takechi | 405/233 |
| 3,345,826 | 10/1967 | Hignite | 405/251 |
| 3,512,316 | 5/1970 | Turzillo | 405/242 X |
| 3,690,109 | 9/1972 | Turzillo | 405/241 |
| 3,962,879 | 6/1976 | Turzillo | 405/236 |
| 4,738,568 | 4/1988 | Steding | 405/241 |
| 4,790,689 | 12/1988 | Henn et al. . | |

FOREIGN PATENT DOCUMENTS

| | | | |
|---|---|---|---|
| 754765 | 1/1971 | Belgium . | |
| 0127221 | 12/1984 | European Pat. Off. . | |
| 0065340 | 11/1985 | European Pat. Off. . | |
| 1250513 | 12/1960 | France . | |
| 2180405 | 11/1973 | France . | |
| 523177 | 4/1931 | Germany . | |
| 1097373 | 1/1961 | Germany . | |
| 2206104 | 9/1972 | Germany . | |
| 2949938 | 6/1981 | Germany . | |
| 4-14513 | 1/1992 | Japan | 405/241 |
| 7608927 | 2/1978 | Netherlands . | |
| 7712013 | 5/1978 | Netherlands . | |
| 1344018 | 1/1974 | United Kingdom . | |
| 1402231 | 8/1975 | United Kingdom . | |
| 1458157 | 12/1976 | United Kingdom . | |
| 1595432 | 8/1981 | United Kingdom . | |
| 2267926 | 12/1992 | United Kingdom . | |

*Primary Examiner*—Tamara L. Graysay
*Assistant Examiner*—Frederick L. Lagman
*Attorney, Agent, or Firm*—Sidley & Austin

[57] ABSTRACT

An apparatus for forming a pile in the ground has an elongate member (12, 112), at least one helical thread flight (16, 116) on the elongate member (12, 112), and a torque transmission device (24, 124) to transmit torque from a drive structure to the elongate member (12, 112) and the at least one helical thread flight (16, 116) thereon. The outer diameter of the transmission device is greater than the outer diameter of the elongate member so that the apparatus can be inserted into the ground through a frustoconical depression (50) in the ground by rotating the torque transmission device (24, 124) in a first direction, and upon the reversal of the direction of rotation, a hole is left in the ground with a diameter which is the same as that of the transmission device, and with helical grooves of substantially the same shape as the at least one helical thread flight (16, 116). Cementitious material (58) can be passed through the apparatus to fill the hole in the ground as most of the apparatus is withdrawn from the ground.

34 Claims, 4 Drawing Sheets

APPARATUS FOR USE IN FORMING PILES

FIELD OF THE INVENTION

This invention relates to apparatus for use in forming piles.

BACKGROUND OF THE INVENTION

Conventional methods for driving piles, or pile formers, into the ground, comprise either hammering the pile or pile former, or vibrating the pile or pile former, into the ground.

The disadvantages of such techniques are that damage can be caused to nearby buildings by the hammering, or the vibration, particularly if the buildings are old and unstable, and the techniques are noisy.

A prior proposal disclosed in NL (A) 7 712 013 is a concrete pile formed with a projecting helical threaded protrusion which is inserted into the ground by means of applying a torque thereto in the manner of a screw.

Such piles are relatively complicated and consequently expensive to manufacture and the torque required to drive them is high due to the large surface area in contact with the ground during the insertion procedures.

SUMMARY OF THE INVENTION

It is an object of this invention to obviate and/or mitigate the disadvantages.

According to one aspect of this invention there is provided apparatus for use in forming a pile, said apparatus comprising an elongate member, a helical flight on the elongate member, and a transmission device to transmit torque to the elongate member and flight, whereby the apparatus can be inserted into the ground by torque applied through said transmission device to form at least part of the pile, the transmission device being of greater diameter than the elongate member whereby as the elongate member is inserted into the ground, the transmission device is pulled downwardly through the ground by the elongate member, thus creating a hole in the ground which is of substantially the same width as the transmission device.

Preferably, the elongate member has a first flight arranged towards its free end and a second flight spaced from the first flight. Advantageously, the second flight is so arranged on said elongate member that it follows substantially the path of the first flight when said elongate member is inserted into the ground. Further intermediate flights may be provided between the first and second flight.

Preferably a removable connecting member connects the transmission device to the torque applying means.

One or more elongate extension members are fixable between the connecting member and the torque applying, device.

Preferably, the transmission device is open topped, includes an outer cylinder surrounding an end of the elongate member and having an end converging towards said elongate member and a diametrically extending drive bar.

Preferably the elongate member is a steel tube, the free end of which is closed or flattened into a spade formation. Preferably the transmission, device is welded to the elongate member at the smaller end of the converging portion.

Preferably the connecting member has an outer diameter substantially equal to that of the transmission device and a projecting spigot for insertion into the transmission device, said spigot having a longitudinally extending surface thereon to engage the drive bar to transmit torque to the elongate member and helical flight(s).

Preferably two diametrically opposed longitudinally extending surfaces are provided each having an inclined surface leading thereto such that when the direction of torque application is reversed the connecting member disconnects from the transmission means.

Preferably a further helical flight is formed on the outer surface of the connecting member. Said further helical flight preferably extends for a full revolution, is of a diameter less than the first, second and intermediate flights, but of the same pitch. Alternatively the flights may be of substantially the same diameter.

Preferably the said extension members are hollow.

Each extension member is also provided with appropriate connecting formations to connect one end of the extension member to a further extension member.

Preferably, the connecting formations are in the form of threads.

Preferably the-or-each extension member has at least one aperture formed in its walls.

Preferably means are provided at or near ground level to contain a mass of unset cementitious material through which said extension member extends whereby said material may fill and maintain open the hole and helical grooves behind the transmission device.

In one embodiment, the cementitious material is pumped into the hole, preferably via a bore through the elongate member. The bore may extend through the connecting member.

In another embodiment, a single helical flight is provided on the elongate member and further flights are provided on the extension member.

Preferably, the transmission, device is fixed to the lower end of the extension member.

Preferably, a cylindrical recess is provided in the base of the transmission device to receive the top portion of the elongate member, said member having a radially extending drive bar engageable against drive faces defined by the part of the transmission device defining the recess.

Preferably, inclined surfaces lead from said drive faces so that on reversing the direction of rotation of the apparatus from the drive direction the elongate member becomes detached and separate from the transmission device.

According to another aspect of the invention there is provided a method of forming a pile comprising applying torque by torque applying means to an elongate member having a helical flight thereon to insert the elongate member into the ground, the torque being applied thereto by an assembly including an extension member connectable between the torque applying device and a transmission device which is wider than the extension member and connects the extension member with the elongate member, whereby when the elongate member is inserted into the ground the transmission device is pulled through the ground behind it thereby forming a hole in the ground which is of substantially the same width as the transmission device and greater than the width of the extension member and filling said hole with pile forming material.

Preferably prior to inserting said elongate member and helical flight into the ground a depression is formed in the ground for reception of the elongate member and helical flight. The depression is downwardly inwardly converging with its upper diameter being greater than the outer diameter of the helical flight and its lower diameter being less than the outer diameter of the helical flight.

Preferably the depression is formed by driving a conical mandrel into the ground from ground level. Alternatively the depression is formed by means of an auger or other suitable soil removal means.

Preferably, the hole is filled with pile forming material either during or after the elongate member, transmission device and extension member are inserted. When the hole is filled during the insertion of the elongate member, transmission device and extension member, a mass of pile forming material is maintained in the depression.

Preferably after the elongate member has been inserted into the ground to a desired depth, the extension member is disconnected therefrom and removed by applying torque thereto in the direction opposite to the insertion direction.

Preferably an un-set cementitious material is supplied down the extension member during removal to fill the hole beneath the elongate member before the cementitious material sets. Reinforcement may be placed in the unset cementitious material.

BRIEF DESCRIPTION OF THE DRAWINGS

An embodiment of the invention will now be described by way of example only, with reference to the accompanying drawings, in which.

DETAILED DESCRIPTION

Figure 1:
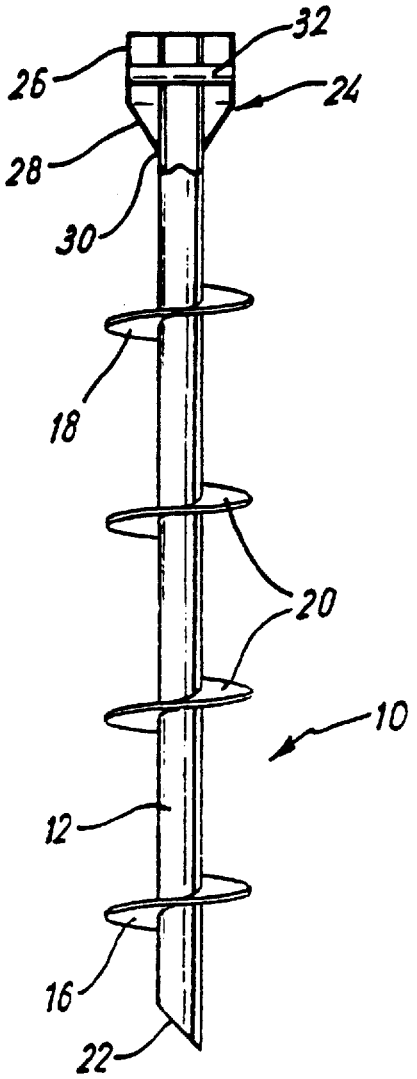
FIG. 1 shows a partially sectioned side elevation view of apparatus for use in forming a pile.
Figure 2:
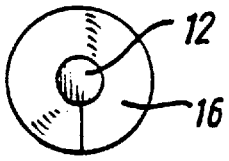
FIG. 2 shows a view of the apparatus of FIG. 1, from below.
Figure 3:
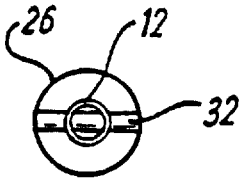
FIG. 3 shows a view of the apparatus of FIG. 1, from above.

Referring in the first instance to FIG. 1 there is shown apparatus 10 for forming a pile and comprising an elongate hollow steel tubular member 12 to which is attached by welding a first helical thread flight 16 near the lower end thereof, a second helical thread flight 18 near the upper end thereof, and two further intermediate thread flights 20 located at longitudinally space intervals between the first helical thread flight 16 and the second helical thread flight 18, all of the said flights having the same pitch, flight 16 angle and diameter so that as the member 12 is rotated into the ground the first flight 16 pulls the member 12 into the ground without displacing the ground in the manner, for example, of a wood screw. The intermediate flight 20 and the second flight 18 follow the first flight 16 in the helical channel formed in the ground by the first flight 16.

The lower end (fill end) of the member 12 is sealed at 22, by being closed or flattened to a spade formation and a transmission means 24 is provided at the upper end of the member. The transmission means 24 is open topped and comprises an open ended outter cylindrical sleeve 26 surrounding the upper end of the elongate member 12 and having a first conical converging portion 28 at its lower end, the portion 28 converging downwardly and inwardly towards the elongate member 12 and merging into the elongate member 12 and being fixed thereto by welding at 30. A diametrically extending steel bar 32 is provided and extends across the interior of the sleeve 26 and through the open end region of the elongate member 12.

The apparatus 10 is inserted into the ground by applying a downward loading thereon and applying a torque in a clock-wise direction. It is inserted into the ground by the thread flights 16, 18, and 20 as these flights all have the same diameter, pitch and angle the flights 20 and 18 will follow the path of the first thread flight 16.

Figure 4:
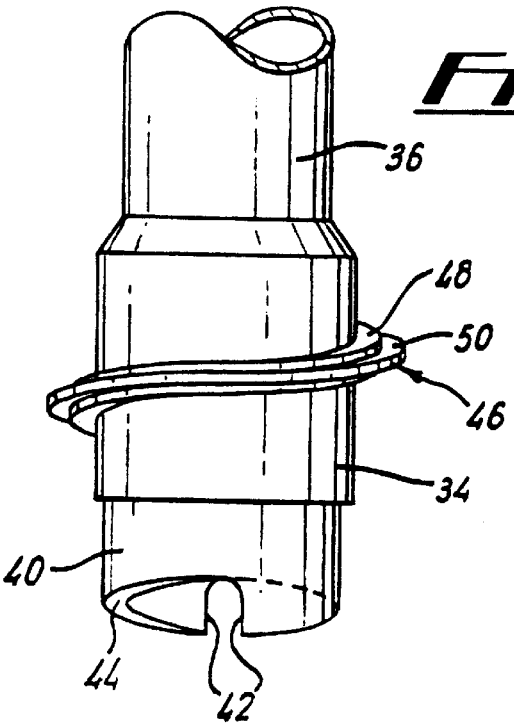
FIG. 4 shows a side elevation view, to an enlarged scale, of a connecting member on the end of an extension member.
Figure 5:
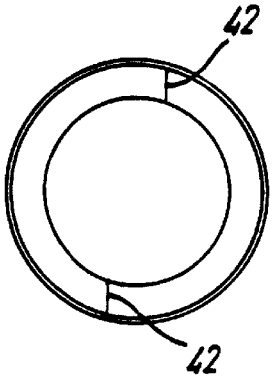
FIG. 5 shows a bottom plan view of the connecting member, of FIG. 4
Figure 6:
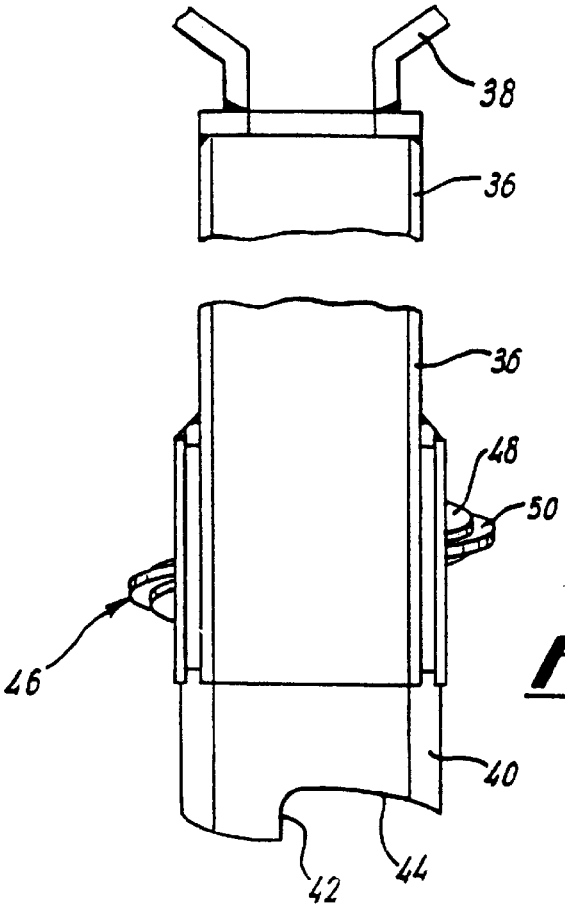
FIG. 6 shows a sectional elevation view of the connecting and extension members of FIG. 4
Figure 7:
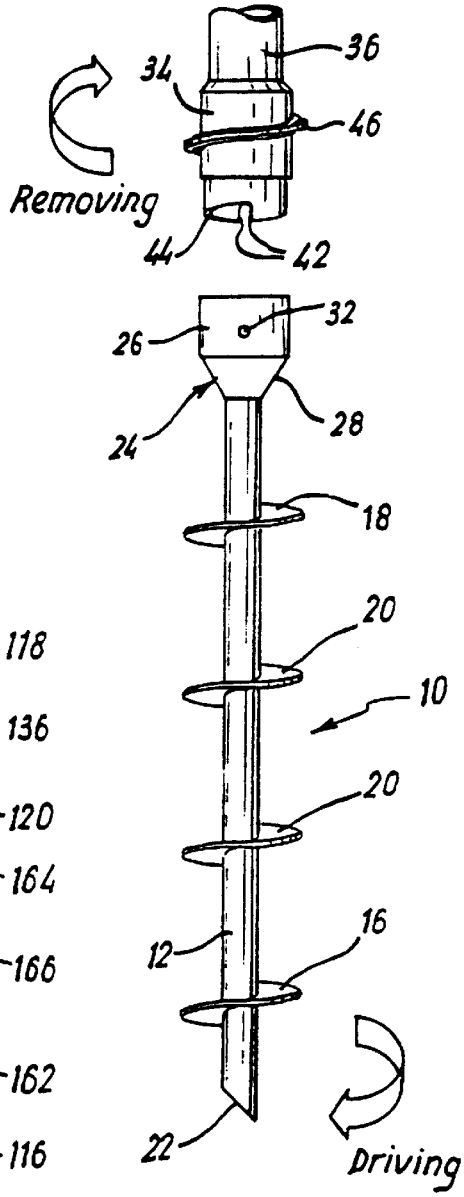
FIG. 7 illustrates the disconnection of the connection and extension members of FIG. 4 from the pile forming member.

FIGS. 4, 5 and 6 show the means for applying torque by transmission from a surface mounted rotating drive member. A hollow connection member 34 having an outside diameter substantially equal to the outside diameter of the transmission means 24 is welded to the end of a hollow tubular steel extension member 36 which, at its upper end, has engagement means 38 for engaging with the driving mechanism (not shown).

An annular spigot 40 extends downwardly from the lower end of the connecting member 34 and is provided with two diametrically opposed longitudinally extending drive faces 42 which, when the spigot 40 is inserted into the transmission means 24 are adapted to abut the drive bar 32 and transmit rotation of the connecting member 34 to the transmission means 24. The inclined surfaces 44 lead into the drive faces 42 and it will be observed that when the connecting and extension members 34, and 36 are driven in a clockwise direction with a downward force supplied thereto the drive faces 42 will engage the bar 32, but when the connecting and extension members 34 and 36 are driven in a counterclockwise direction the inclined surfaces 44 will ride up over the bar 32 and cause disconnection of the driving means 24 from the transmission means.

A helical flight 46 is welded to the outer surface of the connecting member 34. The flight 46, which extends for a full revolution which is has a diameter less than the diameter first, of second and intermediate flights 16, 18, and 20 but has the same pitch and angle as the flights 16, 18, and 20 . Alternatively, the flights can all be of substantially the same diameter. The flight 46 is formed of two outer sections, 48 and an inner section 49 therebetween. Each section 48 and 49 is of substantially the same thickness.

To form a pile the first step is to form a downwardly and inwardly converging frustoconical depression 50 at ground level 52. This can be done by utilizing a conical soil removing auger 54, but if the ground conditions are not suitable for forming a depression by such means then a frusto-conical mandrel can be driven or vibrated into the ground to form the depression 50.

Figure 8:
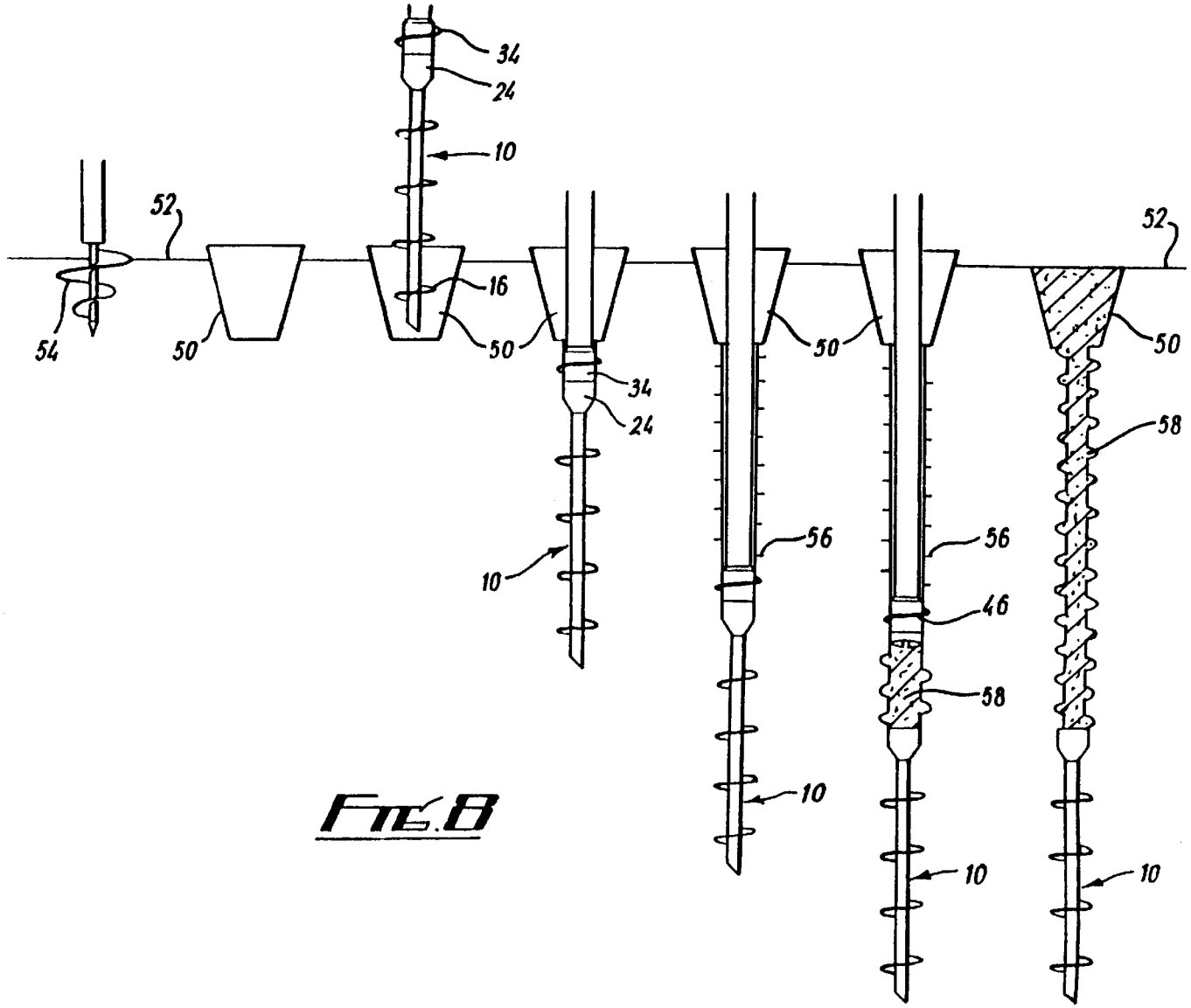
FIG. 8 shows the sequence of operations followed during a pile forming operation.

The pile forming member 10 is then introduced into the depression 50, and it will be noted from FIG. 8 that the upper diameter 50 is greater than the outer diameter of the helical thread flight 116 and the lower (smallest) diameter of the depression 50 is substantially equal to or smaller than the outer diameter of the first flight 16. By applying torque and a downward force, the member 10 is driven into the ground, and it is to be appreciated that as it is inserted it drags the transmission means 24 and connecting member 34 behind it creating a circular hole, the diameter of which is greater than the diameter of the extension member 36, so that the frictional forces from the ground resisting the insertion of the pile forming member 10 are confined at all stages of the driving operation after full penetration of the pile forming member 10 to those experienced by the pile forming member 10 and the connecting member 34.

Thus, generally, the frictional resistance forces during the driving operation are constant, irrespective of the depth of the pile, because effectively no frictional resistance is experienced by the extension member 36. This significantly reduces the power required to drive piles when compared with a normal pile driving operation where the greater the depth of the pile, the greater the frictional forces to be overcome.

When the pile has been driven to a pre-calculated depth, the direction of rotation of the drive means is reversed and an upward force is applied to the extension member 36 and the connecting member 34. This causes separation of the extension and connection members 34 and 36 from the pile forming member 10 comprising the transmission means 24, the elongate member 12 the and helical flights 16, 18, and 20 which remain at the bottom of the pile hole, that is they are sacrificed.

The helical flight 46 on the connecting member 34 occupies the helical groove 56 formed in the ground during descent, and effectively seals off the bottom of the hole left by the retreating connecting member 34 so that cementitious material 58, for example grout or concrete, supplied down the bore of the extension member 36 fills the hole behind the retreating connecting and extension members 34 and 36 the hole being kept clear of debris by the ascending connecting member 34 and the helical flight 46 thereon. Alternatively, grout or concrete is supplied to the depresssion 50 during the entire pile hole forming operation and flows into the hole behind the retreating extension member 36 via a bore extending through the connecting member 34. During this operation a hydrostatic head is maintained by the unset cementitious material 58, or water or any other suitable fluid maintained in the depression 50.

Prior to the setting of the cementitious material 58 reinforcing bars can be inserted into the fully filled hole and depression 50. If desirable, the bars are mechanically connected with the pile forming member 10 remaining down the hole by means of, for example, a bayonet connection with the drive bar 32.

Figure 9:
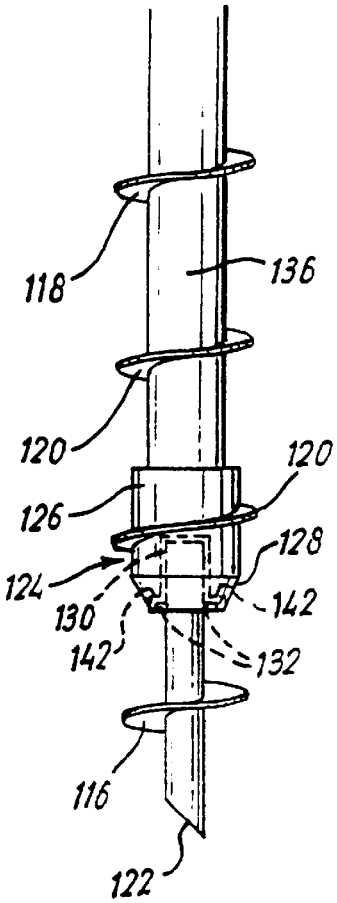
FIG. 9 shows a side elevation view similar to FIG. 1 of yet another embodiment.
Figure 10:
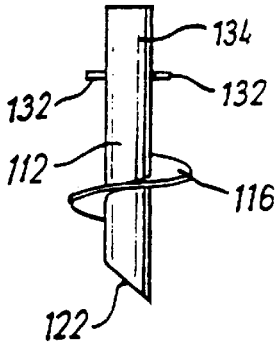
FIG. 10 shows part of the embodiment shown in FIG. 9.

FIGS. 9 and 10 show a modification of the embodiment illustrated in the earlier figures. It will be appreciated that in the embodiment shown in FIGS. 1 to 8, the pile forming member 10 remaining down the hole is relatively expensive and the modification shown in FIGS. 9 and 10 provides a less expensive arrangement whereby only a shorter tubular member 112, having only a single thread flight 116, remains down the hole.

FIG. 10 illustrates the member which is left down the hole. It can be seen to comprise a relatively short hollow steel tubular member 112 to which is attached by welding a first helical thread flight 116. At the lower end the tubular member 112 is closed off in a chisel shape 122 and near the upper end there is provided a drive bar 132 extending through the tubular member 112 and projecting radially from each side thereof.

In this modification the extension member 136 carries the second and intermediate thread flights 118 and 120 and fixed to the bottom end of the connecting member 136 by welding is the transmission means 124, the outside diameter of which is greater than the outside diameter of the extension member 136 but less than the external diameter of the helical thread flights 116, 118, and 120. A cylindrical recess 130 is formed in the base of the transmission means 124 and receives the upper end 134 of the member 112. Extending from the recess 130 and defined by the transmission means 124 are driving faces 142 to engage the drive bar 132 the faces 142 being connected to inclined surfaces (not shown) such that drive can be transmitted to the member 112 in the manner described above with reference to FIGS. 4, 5 and 6 and, on reversing the direction of rotation of the extension member 136, the member 112 can be disconnected from the transmission means 124.

As in the earlier embodiments the connection member 134 has an upper cylindrical section 126 and a lower frusto-conical section 128.

It will be realized therefore that the modification illustrated in FIGS. 9 and 10 is utilized in the same manner as the embodiment described with reference to FIGS. 1–8.

Figure 11:
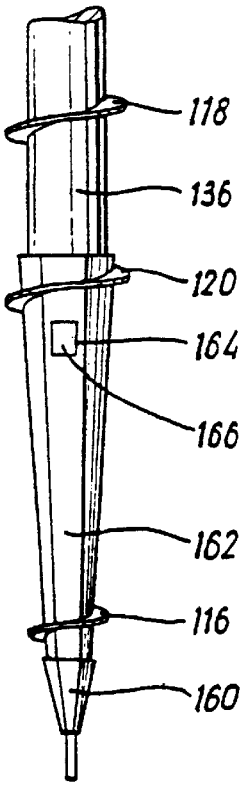
FIG. 11 shows a side elevation view similar to FIG. 1 of a still further embodiment.

Similar comments regarding mode of operation apply to the modification illustrated in FIG. 11, where only the tip 160 is left down the hole.

In the modification the extension member 136 has an elongate hexagonal cross-section tapering end portion 162, corresponding to the elongate member and the transmission member permanently fixed, as the lower end of the extension member 136. Second and intermediate thread flights 118, and 120 are welded to an upper part of the extension member 136 and the end portion 162, respectively as before and the end portion 162 carries also the first helical thread flight 116.

The sacrificial tip 160 is also of hexagonal cross-section and is a push fit on the end of the lower end portion 162 so that when the direction of rotation is reversed to withdraw the extension member 136 and end portion 162 only the tip 160 remains down the hole formed during the operation.

Cementitious material, for example, grout fed down the bore of the extension member 136 will exit into the formed pile hole through the now open end of the tapering end portion 162 and also through a port 164 located in the end portion 162 near the upper end of the end portion 162. The port 164 is equipped with a closure 166 which keeps the port 164 closed until a suitable mechanism opens it when the direction of rotation is reversed for the withdrawal of the extension member 136.

In a further modification where the head room in which the pile insertion apparatus has to operate is limited, the extension member 136 can comprise a plurality of interconnectable sections such that its length can be built up as it progresses down the hole.

In a further modification, the extension member can remain down the hole after the hole forming operation to provide the reinforcement. In this modification unset micro concrete is supplied down the extension member and enters the hole at the connection member. A suitable supply of micro concrete is provided to ensure that the hole behind the connecting member and the depression is full to overflowing and the overflowing unset micro concrete is collected from the depression and recycled to the concrete mixer and pump which supplies the micro concrete to the extension member.

I claim:

1. Apparatus for use in forming a pile in the ground, said apparatus comprising:

an elongate member having an exterior with an outer diameter;

at least one helical thread flight mounted on said exterior of said elongate member; and a transmission device to transmit rotational torque to said elongate member and said at least one helical thread flight, said transmission device having an outer diameter which is greater than said outer diameter of said elongate member, whereby the apparatus can be inserted into the ground by application of rotational torque in a first direction through said transmission device so that said elongate member is pulled downwardly through the ground by said at least one helical thread flight, thus creating a hole in the ground which is of substantially the same diameter as said transmission device, wherein said hole has helical grooves of substantially the same helical shape as said at least one helical thread flight.

2. An apparatus in accordance with claim 1, wherein said at least one helical thread flight comprises a first helical thread flight mounted on said elongate member near a lower end of said elongate member and a second helical thread flight mounted on said elongate member near an upper end of said elongate member so as to be spaced from said first helical thread flight.

3. An apparatus in accordance with claim 2, wherein said second helical thread flight is mounted on said elongate member so that said second helical thread flight follows substantially a path of said first helical thread flight as said elongate member is inserted into the ground.

4. An apparatus in accordance with claim 2, further comprising at least one intermediate helical thread flight mounted on said elongate member between said first helical thread flight and said second helical thread flight.

5. An apparatus in accordance with claim 4, wherein said second helical thread flight and each of said at least one intermediate helical thread flight are mounted on said elongate member so that said second helical thread flight and each of said at least one intermediate helical thread flight follow substantially a path of said first helical thread flight as said elongate member is inserted into the ground.

6. An apparatus in accordance with claim 1, wherein said transmission device is open topped and comprises an outer cylindrical sleeve portion positioned about an upper end of said elongate member so as to surround said upper end of said elongate member, a converging portion which converges downwardly and inwardly from said outer cylindrical sleeve portion toward said elongate member, and a drive bar extending diametrically across said outer cylindrical sleeve portion.

7. An apparatus in accordance with claim 6, wherein a smaller end of said converging portion of said transmission device is welded to said elongate member.

8. An apparatus in accordance with claim 1, wherein said elongate member is a metal tube with a lower end of said metal tube being flattened into a spade form.

9. An apparatus in accordance with claim 1, further comprising a torque applying device, and a removable connecting member for selectively connecting said transmission device to said torque applying device.

10. An apparatus in accordance with claim 9, wherein said elongate member has a drive bar extending diametrically across the outer diameter of said transmission device, and wherein said connecting member has an outer diameter which is substantially equal to the outer diameter of said transmission device, and wherein said connecting member has a downwardly projecting spigot for insertion into said transmission device, said spigot having at least one longitudinally extending surface thereon to engage said drive bar to transmit torque to said elongate member and said at least one helical thread flight as said connecting member is rotated in said first direction.

11. An apparatus in accordance with claim 10, wherein said at least one longitudinally extending surface comprises two diametrically opposed longitudinally extending surfaces, each of said two diametrically opposed longitudinally extending surfaces having an inclined surface leading thereto such that when said connecting member is rotated in a second direction, which is opposite to said first direction, said connecting member disconnects from said transmission device.

12. An apparatus in accordance with claim 9, further comprising a further helical thread flight mounted on an outer surface of said connecting member.

13. An apparatus in accordance with claim 12, wherein said further helical flight extends for a full revolution, has a diameter which is less than or equal to a diameter of each of said at least one helical thread flight, and has a pitch which is the same as a pitch of said at least one helical thread flight.

14. An apparatus in accordance with claim 9, wherein said torque applying device comprises at least one extension member fixable to said connecting member.

15. An apparatus in accordance with claim 14, wherein each said at least one extension member is hollow.

16. An apparatus in accordance with claim 14, wherein said at least one helical thread flight mounted on said elongate member is a single helical thread flight, and further comprising at least one helical thread flight mounted on said at least one extension member.

17. An apparatus in accordance with claim 1, further comprising a torque applying device, wherein said torque applying device comprises at least one extension member, and wherein said transmission device is fixed to a lower end of said at least one extension member.

18. An apparatus in accordance with claim 17, wherein said transmission device contains a recess in a lower end of said transmission device to receive a top portion of said elongate member, wherein said lower end of said transmission device has at least one drive face defining said recess, and wherein said elongate member has a radially extending drive bar which is engageable against said at least one drive face for selectively connecting said torque applying device to said elongate member.

19. An apparatus in accordance with claim 18, wherein said transmission device has an inclined surface leading from each of said at least one drive face so that on reversing the direction of rotation from said first direction to a second direction which is the opposite of said first direction, said elongate member becomes detached from said transmission device.

20. An apparatus in accordance with claim 1, further comprising at least one extension member, wherein said transmission device is fixed to a lower end of said at least one extension member for rotation therewith, wherein said elongate member is fixed to a lower end of said transmission device, whereby as said transmission device is rotated in a first direction, said elongate member is inserted into the ground and said transmission device is pulled downwardly through the ground by said elongate member.

21. An apparatus in accordance with claim 20, wherein a lower end of said elongate member is provided with a removable end cap.

22. An apparatus in accordance with claim 20, wherein said elongate member has a hollow hexagonal cross-section, and wherein said elongate member has a selectively closeable port, said port being closed when said apparatus is being driven into a hole and being open when said elongate member is being removed from said hole.

23. A method of forming a pile in the ground, said method comprising the steps of:

positioning an apparatus in contact with the ground, said apparatus comprising a transmission device having an elongate member extending downwardly therefrom and an extension member extending upwardly therefrom, said elongate member having at least one helical thread flight mounted on an exterior surface of said elongate member to insert said elongate member into the ground upon the rotation of said transmission device in said first direction, said transmission device having a width which is greater than a width of said elongate member, rotating said apparatus in said first direction to insert said elongate member and said transmission device into the ground to form a hole in the ground which is of substantially the same width as said transmission device, said hole having helical grooves of substantially the same helical shape as said at least one helical thread flight and filling said hole with a settable material.

24. A method in accordance with claim 23, further comprising, prior to positioning said apparatus in contact with the ground, forming a depression in the ground for the reception of said apparatus.

25. A method in accordance with claim 24, wherein said depression is downwardly and inwardly converging, an upper diameter of said depression being greater than an outer diameter of each of said at least one helical thread flight, and a lower diameter of said depression being less than said outer diameter of each of said at least one helical thread flight.

26. A method in accordance with claim 24, wherein said step of forming a depression comprises using an auger to form said depression.

27. A method in accordance with claim 24, further comprising maintaining a mass of a settable pile forming material in said depression during the insertion of said apparatus through said depression into the ground so that said hole is filled during the insertion of said apparatus into the ground by material from said mass of material in said depression.

28. A method in accordance with claim 23, wherein said step of filling said hole with a settable material comprises filling said hole with a settable pile forming material during the insertion of said apparatus into the ground.

29. A method in accordance with claim 23, wherein said step of filling said hole with a settable material comprises filling said hole with a settable pile forming material after said apparatus has been inserted into the ground.

30. A method in accordance with claim 23, wherein said step of filling said hole with a settable material comprises filling said hole with a settable pile forming material as at least a portion of said apparatus is being withdrawn from said hole.

31. A method in accordance with claim 30, wherein said settable pile forming material is passed downwardly through said extension member as said at least a portion of said apparatus is being withdrawn from said hole so as to fill the hole beneath said elongate member before said settable pile forming material sets.

32. A method in accordance with claim 23, further comprising, after said elongate member has been inserted into the ground to a desired depth, disconnecting at least a portion of said elongate member from said apparatus by applying torque to said apparatus in a second direction which is opposite to said first direction.

33. A method in accordance with claim 23, further comprising, after said elongate member has been inserted into the ground to a desired depth, disconnecting said elongate member from said transmission device by applying torque to said transmission device in a second direction which is opposite to said first direction.

34. A method in accordance with claim 23, further comprising applying a vertical load to said elongate member as said apparatus is inserted into the earth.

* * * * *